US012595940B2

(12) United States Patent
Schmidt et al.

(10) Patent No.: US 12,595,940 B2
(45) Date of Patent: Apr. 7, 2026

(54) HEAT PUMP

(71) Applicant: VIESSMANN CLIMATE SOLUTIONS SE, Allendorf (DE)

(72) Inventors: Thorsten Schmidt, Marburg (DE); Eduard Lang, Allendorf (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 145 days.

(21) Appl. No.: 18/274,520

(22) PCT Filed: Jan. 31, 2022

(86) PCT No.: PCT/DE2022/100083
§ 371 (c)(1),
(2) Date: Jul. 27, 2023

(87) PCT Pub. No.: WO2022/171239
PCT Pub. Date: Aug. 18, 2022

(65) Prior Publication Data

US 2024/0093918 A1 Mar. 21, 2024

(30) Foreign Application Priority Data

Feb. 10, 2021 (DE) ..... 10 2021 103 061.7

(51) Int. Cl.
*F25B 30/02* (2006.01)
*F25B 41/40* (2021.01)

(52) U.S. Cl.
CPC ..... *F25B 30/02* (2013.01); *F25B 41/40* (2021.01); *F25B 2500/12* (2013.01); *F25B 2500/13* (2013.01)

(58) Field of Classification Search
CPC ..... F25B 30/02; F25B 41/40; F25B 23/006; F25B 2500/12; F25B 2500/13
See application file for complete search history.

(56) References Cited

U.S. PATENT DOCUMENTS 6,260,373 B1 * 7/2001 Rockwood ..... F25D 23/006 165/69
2013/0174589 A1 * 7/2013 Wightman ..... F25B 30/02 62/81
2019/0203988 A1 7/2019 Kobayashi et al.

FOREIGN PATENT DOCUMENTS

DE 10 2009 021 386 A1 11/2009
DE 10 2012 111 486 A1 5/2014
WO 91/06811 A2 5/1991

OTHER PUBLICATIONS

International Search Report in PCT/DE2022/100083, mailed May 17, 2022.

(Continued)

*Primary Examiner* — Tavia Sullens
(74) *Attorney, Agent, or Firm* — Collard & Roe, P.C.

(57) ABSTRACT

A heat pump includes a compressor that is connected via two refrigerant-conveying fluid lines to a heat pump component through which refrigerant flows, wherein each fluid line has a longitudinal axis, wherein an imaginary direction vector which coincides with the longitudinal axis points, on the route between the compressor and the heat pump component, at least once in a different direction to an imaginary starting direction vector which begins at the compressor, where it likewise coincides with the longitudinal axis, wherein the longitudinal axis extends in a space having three imaginary, mutually perpendicular planes. The fluid line is shaped such that the direction vector, on the route between the compressor and the heat pump component, and with respect to all three planes, extends so as to be rotated by an angle of more than 180° relative to the starting direction vector at least once.

5 Claims, 4 Drawing Sheets

(56) References Cited

OTHER PUBLICATIONS

English translation of the International Preliminary Report on Patentability in PCT/DE2022/100083, mailed Aug. 24, 2023.

* cited by examiner

HEAT PUMP

CROSS REFERENCE TO RELATED APPLICATIONS

This application is the National Stage of PCT/DE2022/100083 filed on Jan. 31, 2022, which claims priority under 35 U.S.C. § 119 of German Application No. 10 2021 103 061.7 filed on Feb. 10, 2021, the disclosure of which is incorporated by reference. The international application under PCT article 21(2) was not published in English.

The invention relates to a heat pump according to the preamble of claim 1.

A heat pump of the type mentioned in the introduction is disclosed in the document DE 10 2012 111 486 A1. This heat pump consists of a compressor which is configured to be connected via two refrigerant-conveying fluid lines to a heat pump component through which refrigerant flows, wherein each fluid line has a longitudinal axis, wherein an imaginary direction vector which coincides with the longitudinal axis points, on the route between the compressor and the heat pump component, at least once in a different direction to an imaginary starting direction vector which begins on the compressor, where it likewise coincides with the longitudinal axis, wherein the longitudinal axis is configured to extend in a space having three imaginary, mutually perpendicular planes.

The proviso outlined in claim 1, namely that "two" refrigerant-conveying fluid lines are provided, is to be understood in the sense of "at least two" fluid lines, namely at least one supply line to the compressor and at least one discharge line from the compressor. However, there are also compressors with intermediate injection; in this case then three fluid lines would have to be assumed.

The proviso outlined in claim 1, namely that "one" heat pump component is provided, is to be understood in the sense of "at least one" heat pump component, namely for example a 4-3-way valve, by which the compressor is configured to be connected via two fluid lines. However, two heat pump components can also be provided, namely when for example there is no 4-3-way valve and the compressor is configured to be connected, on the one hand, to an evaporator and, on the other hand, to a condenser. Moreover, an attachment of the compressor to an accumulator is also possible.

Preferably, it should also be mentioned that said starting direction vector can point in any direction starting from the compressor, i.e. for example also upwardly, namely when the fluid line is connected to the top of the compressor.

The object of the invention is to improve a heat pump of the type mentioned in the introduction. In particular, the sound emitted by the heat pump is intended to be further reduced.

This object is achieved by a heat pump of the type mentioned in the introduction by the features set forth in the characterizing part of Claim 1.

According to the invention, it is thus provided that the fluid line is shaped such that the direction vector, on the route between the compressor and the heat pump component, and with respect to all three planes, is configured to extend so as to be rotated by an angle of at least 180° to the starting direction vector at least once.

Expressed again in more precise terms, it is thus provided that a vector projection of the direction vector, on the route between the compressor and the heat pump component, is configured to extend on each individual plane of the three planes so as to be rotated by an angle of 180° to the starting direction vector at least once. This proviso has the effect that a force transmission from the compressor to the heat pump component is effectively prevented in all three spatial directions X, Y and Z and in all three rotational directions about the axes X, Y and Z, and namely since the twisting or the "serpentine guidance" of the fluid line ultimately brings about an increase in its resilience. Since generally an extension of the fluid line is required for implementing this proviso, this is accepted with a view to the noise reduction achieved.

Particularly preferably, it is provided that said rotation of the direction vector with respect to all three planes is at least 270°, quite particularly preferably at least 360°.

Further advantageous developments are found in the dependent claims.

For the sake of completeness, reference is also made to the heat pump VITOCAL 300-A which is manufactured and distributed by the applicant, in which some fluid lines are configured to extend repeatedly twisted or curved or kinked, but not the lines leading from the compressor to the 4-3-way valve, i.e. the heat pump component to which the compressor is configured to be directly connected in this solution via the two fluid lines.

The heat pump according to the invention, including its advantageous developments according to the dependent claims, is explained in more detail hereinafter with reference to the graphic representation of a preferred exemplary embodiment.

In the drawings

Figure 1:
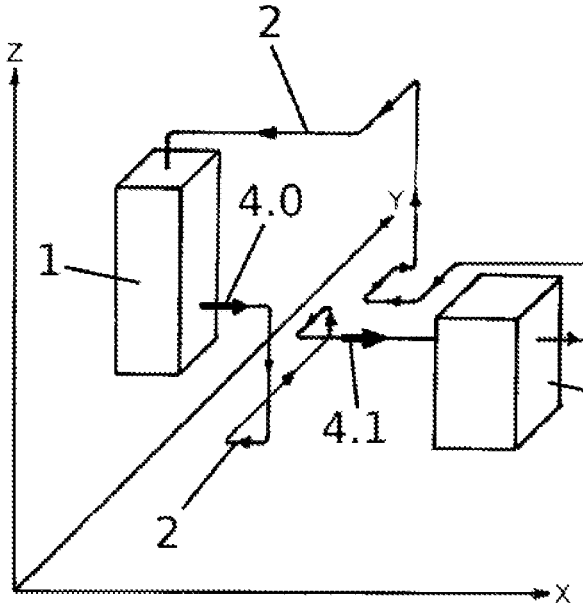
FIG. 1 shows schematically the heat pump according to the invention with the fluid line wound in all directions between the compressor and the heat pump component.
Figure 2:
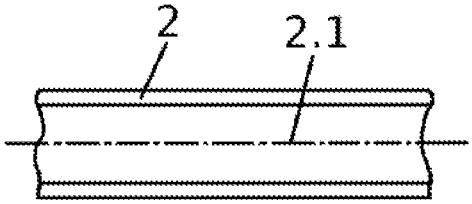
FIG. 2 shows a section through the fluid line according to FIG. 1.

The heat pump shown schematically in FIG. 1 firstly consists in the known manner of a compressor 1 which is configured to be connected via two refrigerant-conveying fluid lines 2 to a heat pump component 3 through which refrigerant flows, wherein each fluid line 2 has a longitudinal axis 2.1 (see FIG. 2), wherein an imaginary direction vector 4.1 which coincides with the longitudinal axis 2.1 points, on the route between the compressor 1 and the heat pump component 3, at least once in a different direction to an imaginary starting direction vector 4.0 which begins on the compressor 1, where it likewise coincides with the longitudinal axis 2.1, wherein the longitudinal axis 2.1 is configured to extend in a space with three imaginary, mutually perpendicular planes XY, XZ, YZ.

In order to eliminate as far as possible a transmission of vibrations from the compressor 1, which preferably comprises an electric motor, to the at least one heat pump component 3, according to the invention it is thus provided that the fluid line 2 is shaped such that the direction vector 4.1, on the route between the compressor 1 and the heat pump component 3, and with respect to all three planes XY, XZ, YZ, is configured to extend so as to be rotated by an angle of 180° to the starting direction vector 4.0 at least once.

As explained in the introduction, considered as a whole this proviso leads to an increase in the resilience or a reduction in the stiffness of the fluid line between the compressor and the heat pump component and thus to a reduced transmission of vibrations.

The solution according to the invention is ultimately based on the fluid line 2 preferably being formed from a metallic material. Optionally, plastics is also preferably considered. The more resilient the material of the fluid line actually used per se, however, the less the approach according to the invention is logically required.

For implementing a flow of refrigerant through the fluid line 2 which is as undisturbed as possible, it is also preferably provided that this fluid line is configured to be continually curved on all of its curved regions. The term "continually" is understood here in the mathematical sense. In other words, it is thus intended to be provided that the fluid line 2 has no sharp-edged kinks. In FIG. 1 the directional changes of the fluid line 2 are shown to be correspondingly rounded.

It is further preferably provided that on the route between the compressor 1 and the heat pump component 3 the fluid line 2 is configured to be at least partially selectively guided around the compressor 1 and/or the heat pump component 3. This proviso, which contributes further to the reduction in the transmission of vibrations, applies to the fluid line 2 leading from the heat pump component 3 to the compressor 1 (as the corresponding arrows indicate).

As mentioned in the introduction, finally it is particularly preferably provided that the fluid line 2 is deflected not only by at least 180° but preferably by at least 270°. Quite particularly preferably, it is provided that the fluid line 2 is shaped such that the direction vector 4.1, on the route between the compressor 1 and the heat pump component 3, and with respect to one of the three planes XY, XZ, YZ, is configured to perform a full 360° turn in comparison with the starting direction vector 4.0. In FIG. 1 both fluid lines 2 shown precisely fulfil this proviso.

Figure 3:
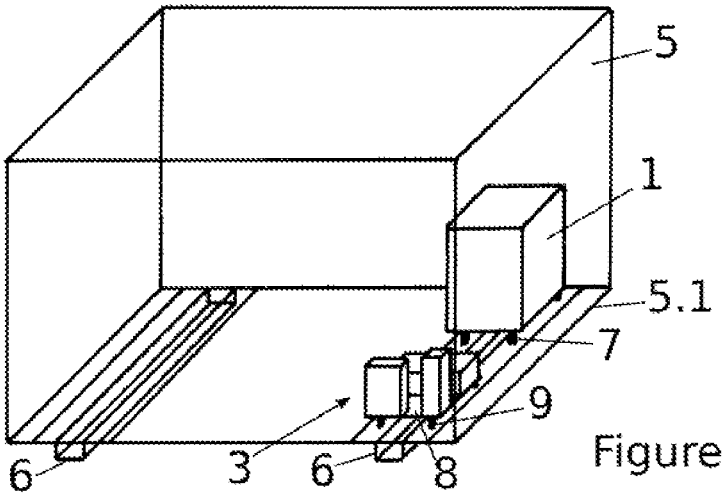
FIG. 3 shows in perspective a heat pump with a support element for the heat pump components.
Figure 4:
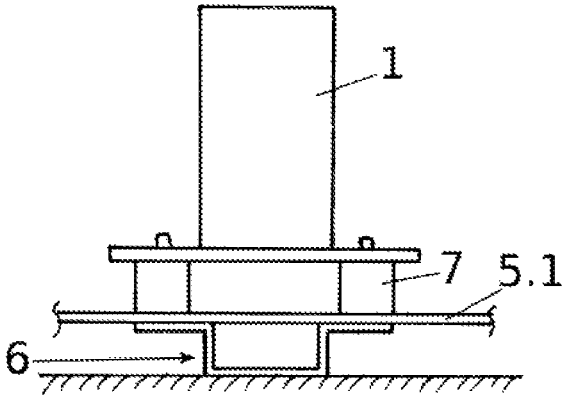
FIG. 4 shows in side view the compressor of the heat pump according to FIG. 3 positioned on a load transfer element.
Figure 5:
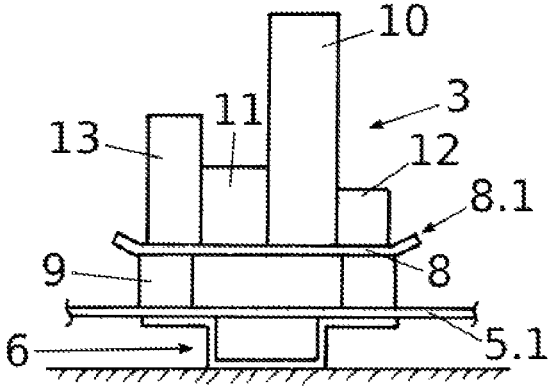
FIG. 5 shows in side view the support element with the heat pump component of the heat pump according to FIG. 3 positioned on the load transfer element.

It is further preferably provided:

The heat pump shown in FIGS. 3 to 5 consists of a housing 5, at least one load transfer element 6 disposed on a lower face 5.1 of the housing 5, the compressor 1 disposed in the housing 5 vertically above the load transfer element 6 and the further heat pump components 3 also disposed in the housing 5, wherein a resilient insulating element 7 is disposed between the compressor 1 and the load transfer element 6.

In the case of this heat pump, it is preferred that a plurality of heat pump components 3 are positioned on a common support element 8 disposed vertically above a load transfer element 6, wherein a resilient insulating element 9 is disposed between the support element 8 and the load transfer element 6.

It is preferred that the lower face 5.1 of the housing 5 consists of a metal sheet disposed between the load transfer element 6 and the resilient insulating element 7, 9, see FIGS. 4 and 5. Moreover, it is preferred that the resilient insulating element 7, 9 is at least partially formed from an elastomer, preferably from polyurethane foam. Moreover, it is preferred that the compressor 1 is configured to be connected to the load transfer element 6 via at least three resilient insulating elements 7 (preferably disposed on the corners of an imaginary triangle).

It is further preferred that two load transfer elements 6 are preferably disposed parallel to one another on the lower face 5.1 of the housing 5. The load transfer element 6 is preferably also preferably configured at least three times, preferably six times, particularly preferably eight times, longer than it is wide or high and/or the load transfer element 6 is preferably configured as a profile rail formed from sheet metal. Additionally, it is preferred that the compressor 1 and the support element 8 are assigned the same load transfer element 6, see FIG. 3.

It is also preferred that a heat exchanger 10, preferably a plate heat exchanger, an expansion device 11, a valve device 12 and/or a refrigerant collector 13 are or is selectively disposed on the support element 8, see FIG. 5. It is also preferred that the support element 8 is configured to be plate-shaped, preferably from sheet metal. The plate-shaped support element 8 is configured to be provided with bent edges 8.1 on the edge side. This serves for stiffening the support element 8 and promotes the rigid-body vibration behaviour of the heat pump. It is further preferred that the heat pump components 3 are disposed so as to be fastened to the support element 8. The support element 8 is preferably and, apart from the contact via the standing surfaces resulting from the arrangement above the load transfer element 6, is also configured to be connected to the load transfer element 6 without fixings. Ultimately this passive block thus simply stands on the load transfer element 6, wherein in particular a lateral displacement is excluded solely by the pipework to the compressor 1.

The heat pump shown in FIGS. 3 to 5 thus has in its above-described embodiments a rigid-body behaviour which leads to an effective insulation of the low-frequency vibrations generated by the heat pump components 3 and, in particular, the compressor 1. As a result, the noise pollution is substantially reduced by the heat pump.

Figure 6:
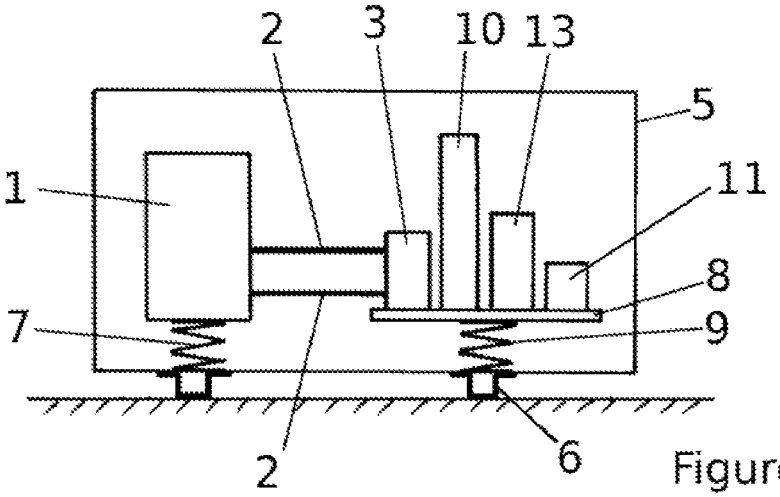
FIG. 6 shows schematically a heat pump with a decoupled compressor.

The heat pump shown in FIG. 6 preferably consists of the compressor 1 for compressing refrigerant and the heat pump components 3 through which refrigerant flows, wherein the compressor 1 for guiding the refrigerant via fluid lines 2 is configured so as to be connected to one of the further heat pump components 3, and wherein the compressor 1 and the further heat pump component 3 are configured to be connected via spring elements to a housing 5 of the heat pump for reducing a transmission of structure-borne sound.

It is preferably provided that the spring elements, which are shown only schematically in FIG. 6, are (actually) formed at least partially from an elastomer, in particular polyurethane foam, i.e. as resilient insulating elements 7, 9.

It is also preferably provided that a first fluid line 2 is configured as refrigerant supply line to the compressor 1 and a second fluid line 2 is configured as a refrigerant discharge line from the compressor 1.

It is also preferably provided that the fluid lines 2 are selectively formed from a material having a stiffness as a metallic material and/or from a metallic material.

In this heat pump it is also preferred that the compressor 1 and the further heat pump component 3 are configured to be fixedly connected together exclusively, on the one hand, via the fluid lines 2 which connect them together and, on the other hand, via the resilient insulating elements 7, 9 connected to the housing 5 of the heat pump. This proviso leads to a particularly effective decoupling of the compressor from the other heat pump components and thus leads to a heat pump having very low noise.

Considered in even more detail, it is particularly preferably provided that the further heat pump component 3 is configured as valve device 6, in particular as a multi-way valve.

It is also particularly preferably provided that the further heat pump component 3 is positioned on a support element 8. It is further preferably provided that the support element 8 is configured to be connected via the spring elements to the housing 5 of the heat pump. It is also further preferably provided that further heat pump components of the heat pump, such as a heat exchanger 10, an expansion device 11 and/or a refrigerant collector 13, are positioned on the support element 8. These further passive heat pump components 3 (since they do not produce vibrations themselves) advantageously form on the support element 8, as can be seen, an integrated subassembly which ultimately is excited to vibrate only via the fluid lines 2.

Figure 7:
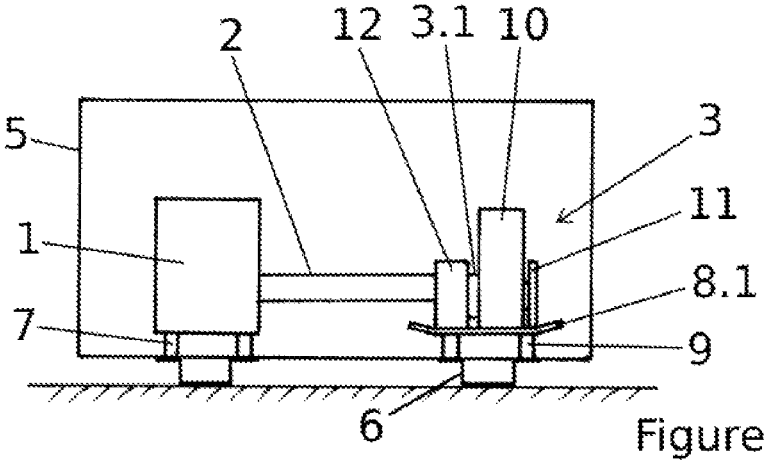
FIG. 7 shows schematically a heat pump with a unit configured as a rigid body and consisting of the support element and heat pump components.

The heat pump shown in FIG. 7 firstly consists in a manner known per se of a compressor 1 for compressing a refrigerant, which compressor operates within an operating speed range and in so doing causes at least one disturbance frequency of the first order, and the heat pump comprises further heat pump components 3 which are disposed on the support element 8 and through which refrigerant also flows.

Considered in more detail, it is preferably provided that at least one heat exchanger 10, a valve device 12 and/or an expansion device 11 are selectively disposed on the support element 8.

It is further preferably provided that a unit composed of the support element 8 and the heat pump components 3 disposed thereon has a first natural frequency which is greater than the disturbance frequency of the first order transmitted by the compressor 1 operating within the operating speed range to the unit acting as a rigid body.

It is particularly preferably provided that the compressor 1 has an operating speed range of 700 to 7200 revolutions per minute, particularly preferably of 800 to 6900 revolutions per minute, quite particularly preferably of 900 to 6600 revolutions per minute.

Moreover, it is particularly preferably provided that the unit consisting of the support element 8 and the heat pump components 3 disposed thereon has a first natural frequency of more than 100 Hz, particularly preferably of more than 120 Hz, quite particularly preferably of more than 140 Hz.

In order to work towards the aforementioned condition, it is also particularly preferably provided that the support element 8 (already) has a first natural frequency which is greater than the disturbance frequency of the first order caused by the compressor 1 operating within the operating speed range.

In order to work further towards the aforementioned condition, it is also particularly preferably provided that each heat pump component 3 has a first natural frequency which is greater than the disturbance frequency of the first order caused by the compressor 1 operating within the operating speed range.

In the event that there is also the requirement for action, due to a corresponding material selection of the pipework 3.1 of the heat pump components 3, it is also further particularly preferably provided that the unit, including the pipework 3.1 of the heat pump components 3, has a first natural frequency which is greater than the disturbance frequency of the first order transmitted by the compressor 1 operating within the operating speed range to the unit acting as a rigid body.

In other words, it is thus preferably provided that in principle a coupled natural frequency of the entire unit is determined or designed on the basis of the local natural frequencies of the individual components such that this is above the first-order disturbance frequency of the compressor 1.

Thus, for example, to increase the local natural frequency, as shown in FIG. 7, it is also provided that the support element 8 is configured as a plate with a bent edge 8.1 for increasing its natural frequency (as already set forth with respect to the heat pump according to FIGS. 3 to 5). Moreover, it can also be preferably provided that the support element 8 is configured to be thicker than is required for the actual loading.

As visible in FIG. 7, it is also preferably provided that the compressor 1 is configured to be fastened via one (typically—as also shown—a plurality of) resilient insulating element(s) 7 to the housing 5 of the heat pump. In a comparable manner, it is also preferably provided that the support element 8 is configured to be fastened to the housing 5 of the heat pump via one (or a plurality of) resilient insulating element(s) 9.

It is also particularly preferably provided that the resilient insulating element 7, 9 is at least partially formed from an elastomer, preferably from polyurethane foam.

It is also preferably provided that the compressor 1 and the unit, apart from the required fluid lines 2 between the compressor 1 and the unit, are configured to be capable of vibration independently of one another.

Finally, in order to ensure a uniform loading of the insulating element 9 (or the insulating elements 9), it is particularly preferably provided that a centre of gravity of the unit is selected—by a suitable arrangement of the heat pump components 3—such that a weight force is vertically introduced into the insulating element 9 (or into the insulating elements 9).

LIST OF REFERENCE SIGNS

1 Compressor
2 Fluid line
2.1 Longitudinal axis
3 Heat pump component
3.1 Pipework
4.0 Starting direction vector
4.1 Direction vector
5 Housing
5.1 Lower face
6 Load transfer element
7 Resilient insulating element
8 Support element
8.1 Bent edge
9 Resilient insulating element
10 Heat exchanger
11 Expansion device
12 Valve device
13 Refrigerant collector
XY Plane perpendicular to XZ and YZ
XZ Plane perpendicular to XY and YZ
YZ Plane perpendicular to XY and XZ

The invention claimed is:

1. A heat pump, comprising
a compressor;
first and second refrigerant-conveying fluid lines; and
a heat pump component comprising a valve;
wherein the compressor is configured to be connected via the first and second refrigerant-conveying fluid lines directly to the heat pump component;

wherein through the heat pump component refrigerant flows;

wherein the refrigerant is conveyed between the compressor and the heat pump component via a route;

wherein the first refrigerant-conveying fluid line has a first longitudinal axis and the second refrigerant-conveying fluid line has a second longitudinal axis;

wherein an imaginary direction vector which coincides with the first longitudinal axis points, on the route between the compressor and the heat pump component, at least once in a different direction to an imaginary starting direction vector which begins at the compressor, where the imaginary starting direction vector likewise coincides with the first longitudinal axis;

wherein the first longitudinal axis is configured to extend in a space having three imaginary, mutually perpendicular planes;

wherein the first refrigerant-conveying fluid line is shaped such that the direction vector, on the route between the compressor and the heat pump component, and with respect to all three planes, is configured to extend so as to be rotated by an angle of 180° with respect to the starting direction vector at least once.

2. The heat pump according to claim 1, wherein the first fluid line has curved regions and is configured to be continually curved on all of the curved regions.

3. The heat pump according to claim 1, wherein the first fluid line, on the route between the compressor and the heat pump component, is configured to be guided at least partially selectively around the compressor and/or the heat pump component.

4. The heat pump according to claim 1, wherein the first fluid line is shaped such that the direction vector, on the route between the compressor and the heat pump component, and with respect to all three planes, is configured to extend so as to be rotated by an angle of 270° with respect to the starting direction vector at least once.

5. The heat pump according to claim 1, wherein the first fluid line is shaped such that the direction vector, on the route between the compressor and the heat pump component, and with respect to all three planes, is configured to extend so as to be rotated by an angle of 360° with respect to the starting direction vector at least once.

* * * * *